US005857301A

United States Patent [19]

Fujita

[11] Patent Number: 5,857,301

[45] Date of Patent: Jan. 12, 1999

[54] ENCLOSING PLATE MOUNTING DEVICE

[75] Inventor: Hideo Fujita, Kawasaki, Japan

[73] Assignee: Fujita Kenzo Kogyo Co., Ltd., Kawasaki, Japan

[21] Appl. No.: 740,955

[22] Filed: Nov. 5, 1996

[30] Foreign Application Priority Data

Nov. 7, 1995 [JP] Japan ..... 7-313449

[51] Int. Cl.[6] ..... E04B 5/52

[52] U.S. Cl. ..... 52/478; 52/489.1; 248/288.7; 248/392; 403/388

[58] Field of Search ..... 52/478, 489.1, 52/542, 549, 552, 774, 781, 714, 762, 763, 775; 298/228.7, 342, 343; 403/388, 394, 397, 400

[56] References Cited

U.S. PATENT DOCUMENTS

| | | | |
|---|---|---|---|
| 4,091,588 | 5/1978 | Heirich | 52/478 |
| 4,109,437 | 8/1978 | Player et al. | 52/478 |
| 4,192,117 | 3/1980 | Heirich | 52/478 |
| 4,520,607 | 6/1985 | Suckow | 52/489.1 |
| 4,649,689 | 3/1987 | Everman et al. | 52/489.1 X |
| 4,918,898 | 4/1990 | McLeod | 52/478 X |
| 4,982,542 | 1/1991 | Funaki | 52/489.1 X |
| 5,355,646 | 10/1994 | Bischel et al. | 52/489.1 |

*Primary Examiner*—Beth A. Aubrey
*Attorney, Agent, or Firm*—Wenderoth, Lind, Ponack, L.L.P.

[57] ABSTRACT

Raised portions are formed at opposing side portions of a metallic enclosing plate 4*c*, and an outside fitting portion 4*c* and an inside fitting portion are formed on the upper portions of the raised portions. A plurality of the enclosing plates are prepared and they are mutually joined via the raised portions and the outside fitting portion and the inside fitting portion are fitted together and arranged in parallel. A slide engaging portion of a mounting fixture is slidably fitted on the fitting portions of the enclosing plates and a sandwiching portion of the mounting fixture is fitted on a horizontal portion of a beam. In this construction, the enclosing plate can be mounted on the beam without using bolts or screws.

5 Claims, 3 Drawing Sheets

ENCLOSING PLATE MOUNTING DEVICE

BACKGROUND OF THE INVENTION

This invention relates to an enclosing plate mounting device for fixing enclosing plates such as roof shingles or exterior sheets on a beam such as an H-beam.

Heretofore, in one case of fixing roof shingles on a beam such as an H-beam, a mounting member was fixed to a predetermined location of the beam by means of welding, and the roofing shingle was fixed to the mounting member by means of a bolt. In another case, a hole bored in the roofing shingle was matched with a hole bored in the beam at a predetermined location, and the bolt was inserted into these holes to fix the roofing shingle on the beam.

The dimensions of a width of interval of a plurality of mounting portions of the roofing shingles has been predetermined. For this reason, in the conventional foregoing technique, matching the dimensions accurately, and welding the mounting member on the beam at a predetermined position or boring a mounting hole, were difficult. As a result, the roofing shingle fixing process was regarded as inefficient. Furthermore, when the mounting member fixed on the beam or the hole bored on the beam was found to involve an error with respect to the mounting positions, the roofing shingles were not fixed on the beam. In order to eliminate these drawbacks, a roofing shingle mounting device is disclosed in an official Japanese Patent Laid-open Publication No. Hei 5-209449, a mounting fixture mounted on the lower horizontal portion of the beam is slidably fitted, and a raised portion of the roofing shingle is fixed to the mounting member of the mounting fixture by means of the bolt or screw.

In the process according to a conventional technique, as the raised portion of the roofing shingle was fixed on the mounting member of the mounting fixture by means of the bolt or screw, an electric tool was needed, and a wiring installation such as an electric cord or the like was required. Furthermore, in the case of fixing the roofing shingle on the mounting fixture by means of the bolt or screw, there was no room to allow for the thermal expansion of the roofing shingle, and thus there was a concern that the roofing shingle would warp.

SUMMARY OF THE INVENTION

An object of this invention is to resolve the foregoing problems.

This invention is for use in constructing a skelton of elongated beams such as H-beams. Raised portions are provided at opposing sides of each of plural metallic enclosing plates which are arranged and mounted in parallel adjacent a horizontal portion of the beam. The raised portions of each of the enclosing plates are arranged in parallel with and joined to the raised portions of the adjacent enclosing plates. A fitting portion bent in an inverted U-shape is provided on the upper portion of each of the joined raised portions so that the enclosing plates are mutually fitted. On each of the mounting fixtures for mounting a plurality of metallic enclosing plates arranged in parallel on the horizontal portion of the beam, a sandwiching portion capable of fitting freely on the horizontal portion of the beam and a slide engaging portion capable of slidably engaging on the fitting portions of the enclosing plates are provided. The slide engaging portion of the mounting fixture is slidably fitted onto the inverted U-shaped fitting portions which are fit together, and the sandwiching portion of the mounting fixture is fitted on the horizontal portion of the beam to construct an enclosing body such as a roof and an exterior wall or the like.

This invention has been constructed in such a way as described in the foregoing, whereby the metallic enclosing plate may be simply mounted on the beam without using a bolt or screw. With the present invention, work efficiency is enhanced in an epoch-making manner, and the warping of the enclosing plate due to thermal expansion can be prevented.

DETAILED DESCRIPTION OF THE INVENTION

Figure 3:
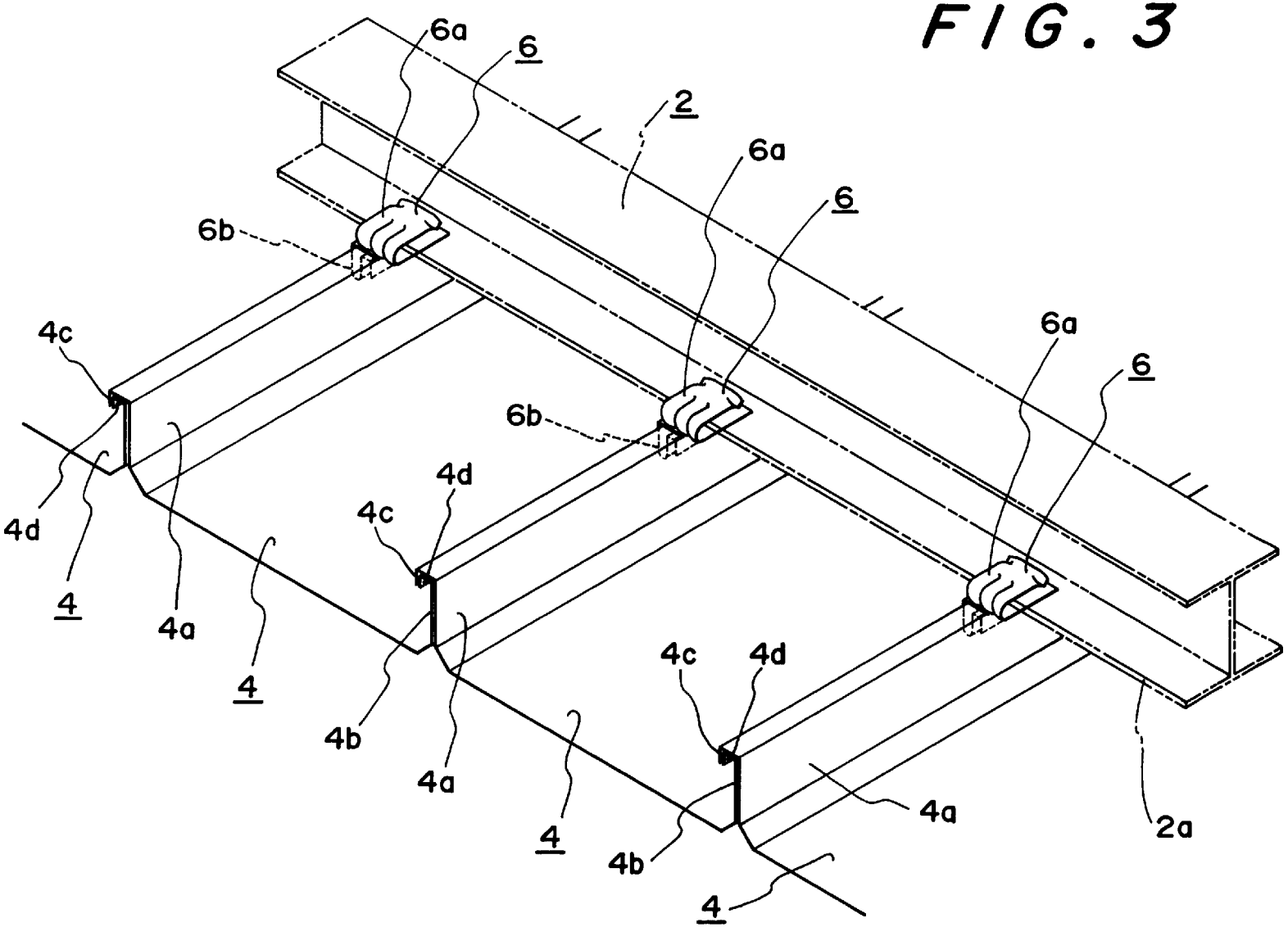
FIG. 3 is an exterior view of this invention.

Hereinbelow, a preferred embodiment of this invention will be described in detail by referring to the attached drawings. Reference numeral 2 denotes a beam which forms a skelton of a building, and comprises an I-beam or an H-beam. Numeral 4 denotes enclosing plates made of metal such as steel or copper. The plates 4 are arranged in parallel and are mutually adjacent to each other at a lower part of the beam 2. Each of the enclosing plates 4, as shown in FIG. 3, is bent so as to have raised portions 4*a*, 4*b* formed at both sides thereof, respectively, and each raised portion has a ⅂-shape cross section.

The upper part of the side wall forming one raised portion 4*a* of enclosing plate 4 has an outside fitting portion 4*c* of ⅂-shape consisting of an outside horizontal portion and a suspending portion suspending from the horizontal portion. The side wall forming the other raised portion 4*b* of the enclosing plate 4 has a ⅂-shaped inside fitting portion 4*d* consisting of an inside horizontal portion and a suspending portion suspending form the horizontal portion. Numeral 6 denotes a mounting fixture formed of metal such as steel, and is comprised of a detachable U-shaped sandwiching portion 6*a* shaped to engage the beam 2 under pressure, and a slide engaging portion 6*b* fixed integrally on the lower surface of the sandwiching portion 6*a*. These mounting fixtures 6 engage a lower horizontal portion 2*a* of the beam 2.

The slide engaging portion 6*b* is formed with bending and warping so as to be slidable from an end portion of the enclosing plates 4 in the longitudinal direction along the fitting portions 4*c*, 4*d* of the pair of outer plates 4 which are fitted and joined mutually.

An operation of the embodiment of this invention will now be described.

Figure 1:
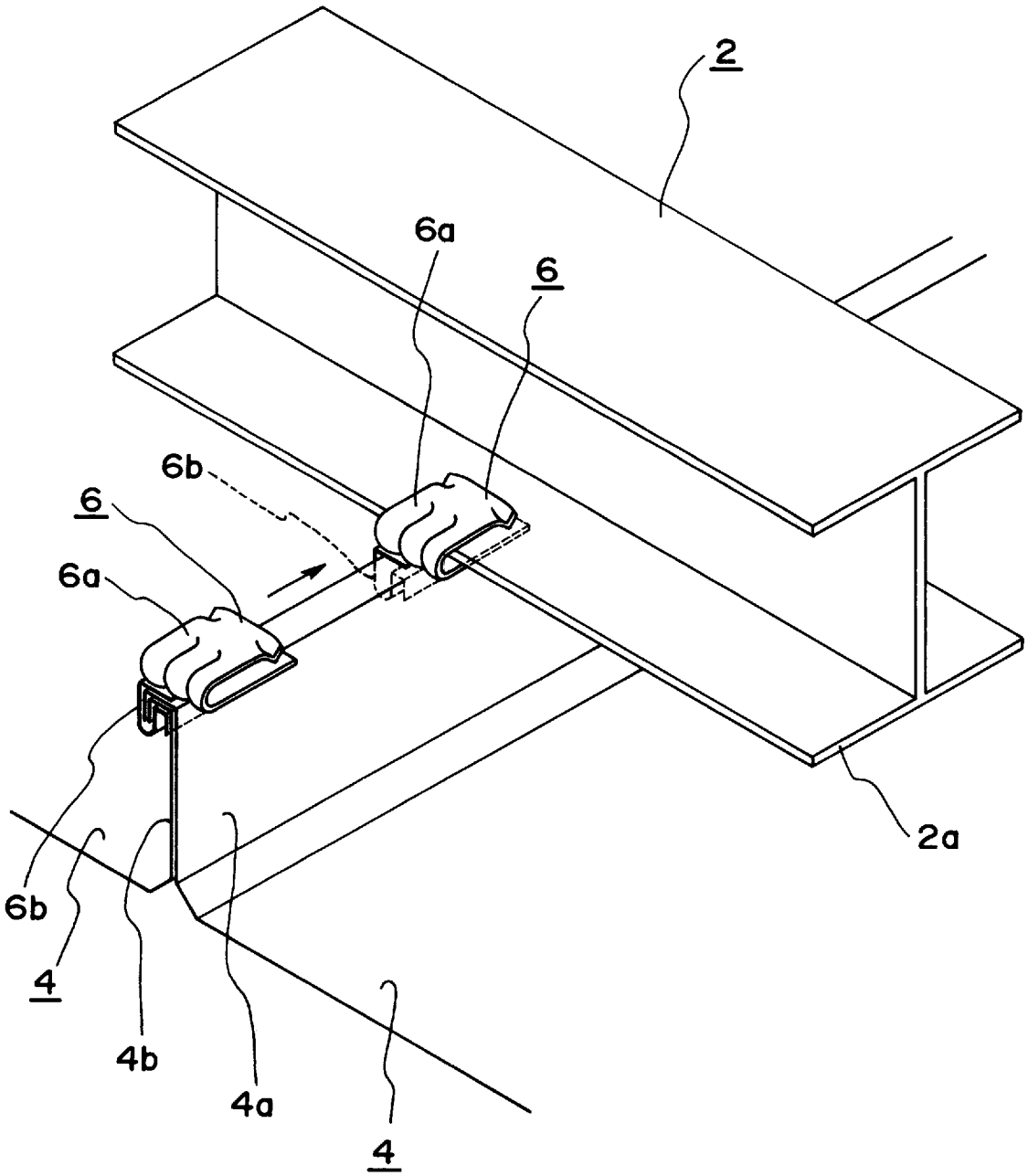
FIG. 1 is an exterior view of an essential portion of a preferred embodiment of this invention.
Figure 2:
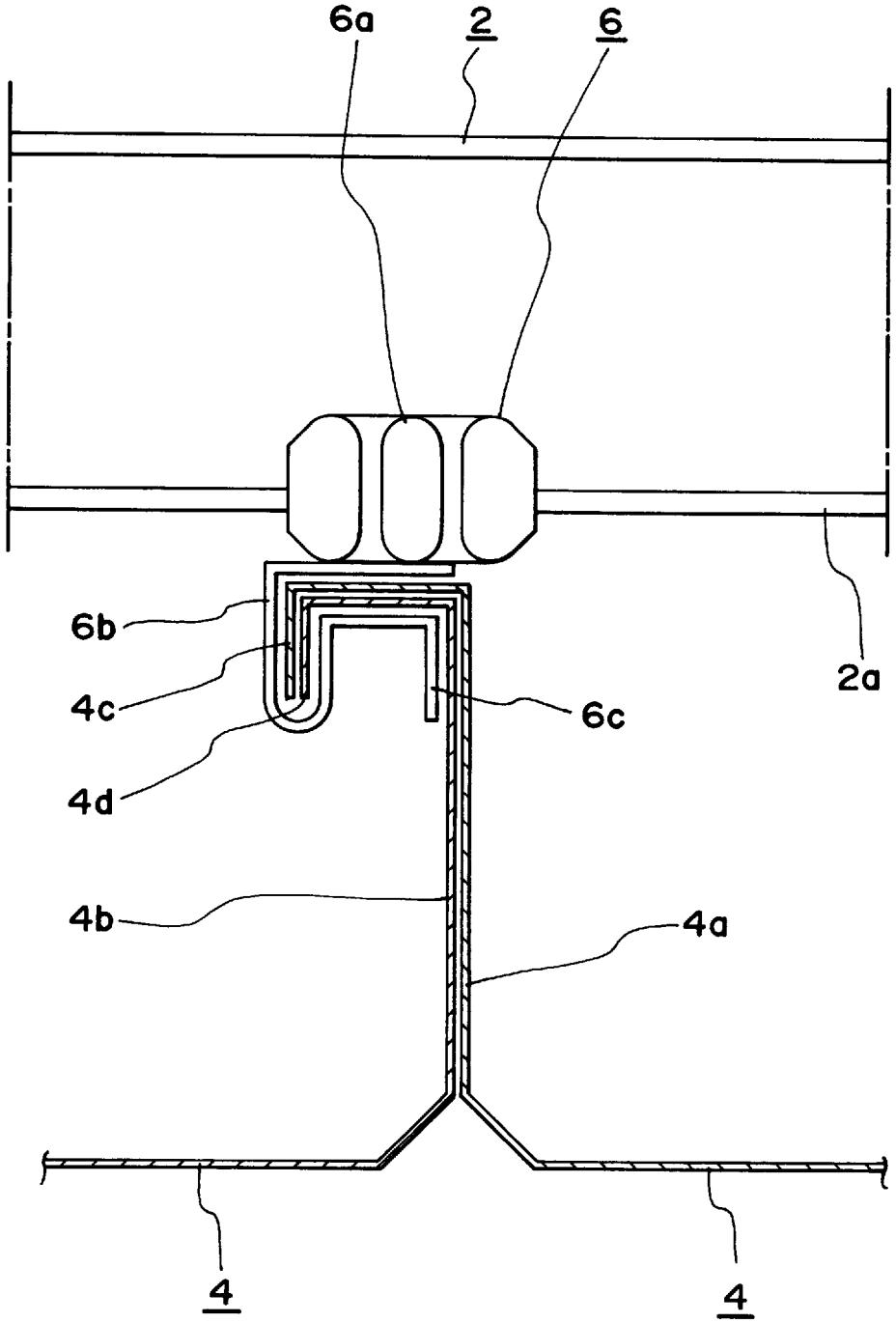
FIG. 2 is an elevation showing a condition where an 25 enclosing plate is mounted on a beam.

A pair of the enclosing plates 4, 4 is adjacently disposed, and the outside fitting portion 4*c* of one of the enclosing plates 4 is fitted on the inside fitting portion 4*d* of the other enclosing plate 4, and the raised portion 4*a* of the enclosing plate 4 and the raised portion 4*b* of the other enclosing plate 4 are caused to abut each other as shown in FIG. 2.

Next, the slide engaging portion 6*b* of a plurality of the mounting fixtures 6 is slidably fitted on the inside and outside fitting portions 4*c* and 4*d* from end portions of the mutually joined enclosing plates 4, 4. The enclosing plates 4, 4 are firmly coupled by the fitting of the slide engaging portion 6*b*. The mounting fixture 6 fitted on the fitting portions 4*c*, 4*d* of the mutually joined enclosing plates 4, 4 is caused to slide along the fitting portions 4*c*, 4*d* to approximately match the positioning of other mounting fixtures mounted on other mutually joined fitting portion as shown in FIG. 3. A required number of enclosing plates 4 described in the foregoing are thus coupled in parallel by the slide engaging portions 6*b* of the mounting fixtures 6.

Next, a required number of mutually coupled enclosing plates 4 are disposed at right angles relative to the lower part of the beam 2. And then, the sandwiching portion 6*a* of the mounting fixture 6 is pressure fitted onto the lower horizontal portion 2*a* of the beam 2. A required number of mutually coupled enclosing plates 4 are fixed on the beam 2. The fixing is sufficiently assured by slidably fitting the slide engaging portion 6*b* of the mounting fixture 6 onto the inside and outside fitting portions 4*c* and 4*d* of a pair of the enclosing plates 4, 4, but for the sake of reinforcement, the raised portions 4*a*, 4*b* of a mutually joined pair of the enclosing plates 4, 4 may be fixed on a suspending member 6*c* of the mounting fixture 6.

What is claimed is:

1. An enclosing plate mounting arrangement comprising:

a pair of adjacent metallic enclosing plates respectively having raised side portions with mutually fitting portions thereon;

a slide engaging portion slidably engaged on and coupling said mutually fitting portions of said raised side portions of said adjacent pair of metallic enclosing plates; and a sandwiching portion mounted to said slide engaging portion for engaging onto a horizontal portion of an elongated beam and coupling said metallic enclosing plates to the beam.

2. The enclosing plate mounting arrangement as recited in claim 1, wherein said sandwiching portion is U-shaped and is for clamping onto the horizontal portion of the elongated beam.

3. The enclosing plate mounting arrangement as recited in claim 2, wherein said mutually fitting portions include an inverted U-shaped outside fitting portion and an inverted U-shaped inside fitting portion nested in the inverted U-shaped outside fitting portion; and said slide engaging portion is shaped to provide a complementary sliding engagement over said mutually engaged pair of said mutually fitting portions.

4. The enclosing plate mounting arrangement as recited in claim 1, wherein said mutually fitting portions include an inverted U-shaped outside fitting portion and an inverted U-shaped inside fitting portion nested in the inverted U-shaped outside fitting portion; and said slide engaging portion is shaped for complementary sliding engagement over said mutually engaged pair of said mutually fitting portions.

5. The enclosing plate mounting arrangement as recited in claim 1, wherein said mutually fitting portions include an inverted U-shaped outside fitting portion formed on an upper portion of one of said raised portions, and an inverted U-shaped inside fitting portion formed on an upper portion of another of said raised portions.

* * * * *